US009776399B2

(12) United States Patent
Fricke et al.

(10) Patent No.: US 9,776,399 B2
(45) Date of Patent: Oct. 3, 2017

(54) MULTIPLE DIGITAL DATA SEQUENCES FROM AN ARBITRARY DATA GENERATOR OF A PRINTHEAD ASSEMBLY

(71) Applicant: HEWLETT-PACKARD DEVELOPMENT COMPANY, L.P., Houston, TX (US)

(72) Inventors: Peter James Fricke, Corvallis, OR (US); Scott A Linn, Corvallis, OR (US); Luca Molinari, Milan (IT)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/308,055

(22) PCT Filed: May 30, 2014

(86) PCT No.: PCT/US2014/040138
§ 371 (c)(1),
(2) Date: Oct. 31, 2016

(87) PCT Pub. No.: WO2015/183295
PCT Pub. Date: Dec. 3, 2015

(65) Prior Publication Data

US 2017/0057224 A1 Mar. 2, 2017

(51) Int. Cl.
*B41J 2/045* (2006.01)

(52) U.S. Cl.
CPC ..... *B41J 2/04541* (2013.01); *B41J 2/0456* (2013.01); *B41J 2/0459* (2013.01);
(Continued)

(58) Field of Classification Search
CPC ..... B41J 2/04541; B41J 2/04543; B41J 2/04558; B41J 2/0456; B41J 2/04561; B41J 2/04573; B41J 2/04581; B41J 2/0459
(Continued)

(56) References Cited

U.S. PATENT DOCUMENTS 6,102,513 A 8/2000 Wen
6,305,773 B1 10/2001 Burr et al.
(Continued)

FOREIGN PATENT DOCUMENTS

JP 10315451 12/1998
JP 2000117980 4/2000
(Continued)

OTHER PUBLICATIONS

Fokkema, Inkjet Printhead Performance Enhancement by Feedforward Input Design Based on Two-port Modeling, Feb. 12, 2007, http://www.dcsc.tudelft.nl/Research/PublicationFiles/publications-6507.pdf.

*Primary Examiner* — Huan Tran
*Assistant Examiner* — Alexander D Shenderov
(74) *Attorney, Agent, or Firm* — HP Inc.-Patent Department

(57) ABSTRACT

In an example, a piezoelectric printhead assembly includes a micro-electro mechanical system (MEMS) die including a plurality of nozzles. An application-specific integrated circuit (ASIC) die is coupled to the MEMS die by a plurality of wire bonds, wherein each of the wire bonds corresponds to a respective nozzle of the plurality of nozzles. An arbitrary data generator (ADG) on the ASIC is to provide a digital data sequence, and a phase selector is to enable multiple data read operations of the ADG to generate multiple delayed digital data sequences.

15 Claims, 7 Drawing Sheets

(52) U.S. Cl.
CPC ..... *B41J 2/04558* (2013.01); *B41J 2/04561* (2013.01); *B41J 2/04573* (2013.01); *B41J 2/04581* (2013.01)

(58) Field of Classification Search
USPC ..... 347/10
See application file for complete search history.

(56) References Cited

U.S. PATENT DOCUMENTS

| | | | |
|---|---|---|---|
| 6,663,208 | B2 | 12/2003 | Suzuki et al. |
| 6,830,305 | B1 | 12/2004 | Takizawa |
| 7,182,421 | B2 | 2/2007 | Kobayashi et al. |
| 7,637,584 | B2 | 12/2009 | Takata |
| 8,353,567 | B1 | 1/2013 | Banerjee et al. |
| 2013/0182026 | A1 | 7/2013 | Satake |

FOREIGN PATENT DOCUMENTS

| | | |
|---|---|---|
| WO | WO2013032475 | 3/2013 |
| WO | WO2013165335 | 11/2013 |

MULTIPLE DIGITAL DATA SEQUENCES FROM AN ARBITRARY DATA GENERATOR OF A PRINTHEAD ASSEMBLY

BACKGROUND

Fluid-jet printing devices eject printing fluid drops such as ink drops onto a print medium, such as paper. The ink drops bond with the paper to produce visual representations of text, images or other graphical content on the paper. In order to produce the details of the printed content, nozzles in a print head accurately and selectively release multiple ink drops as the relative positioning between the print head and printing medium is precisely controlled. Fluid-jet printing technologies include thermal and piezoelectric inkjet technologies. Thermal inkjet printheads eject fluid drops from a nozzle by passing electrical current through a heating element to generate heat and vaporize a small portion of the fluid within a firing chamber. Piezoelectric inkjet printheads use a piezoelectric material actuator to generate pressure pulses that force ink drops out of a nozzle.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1:
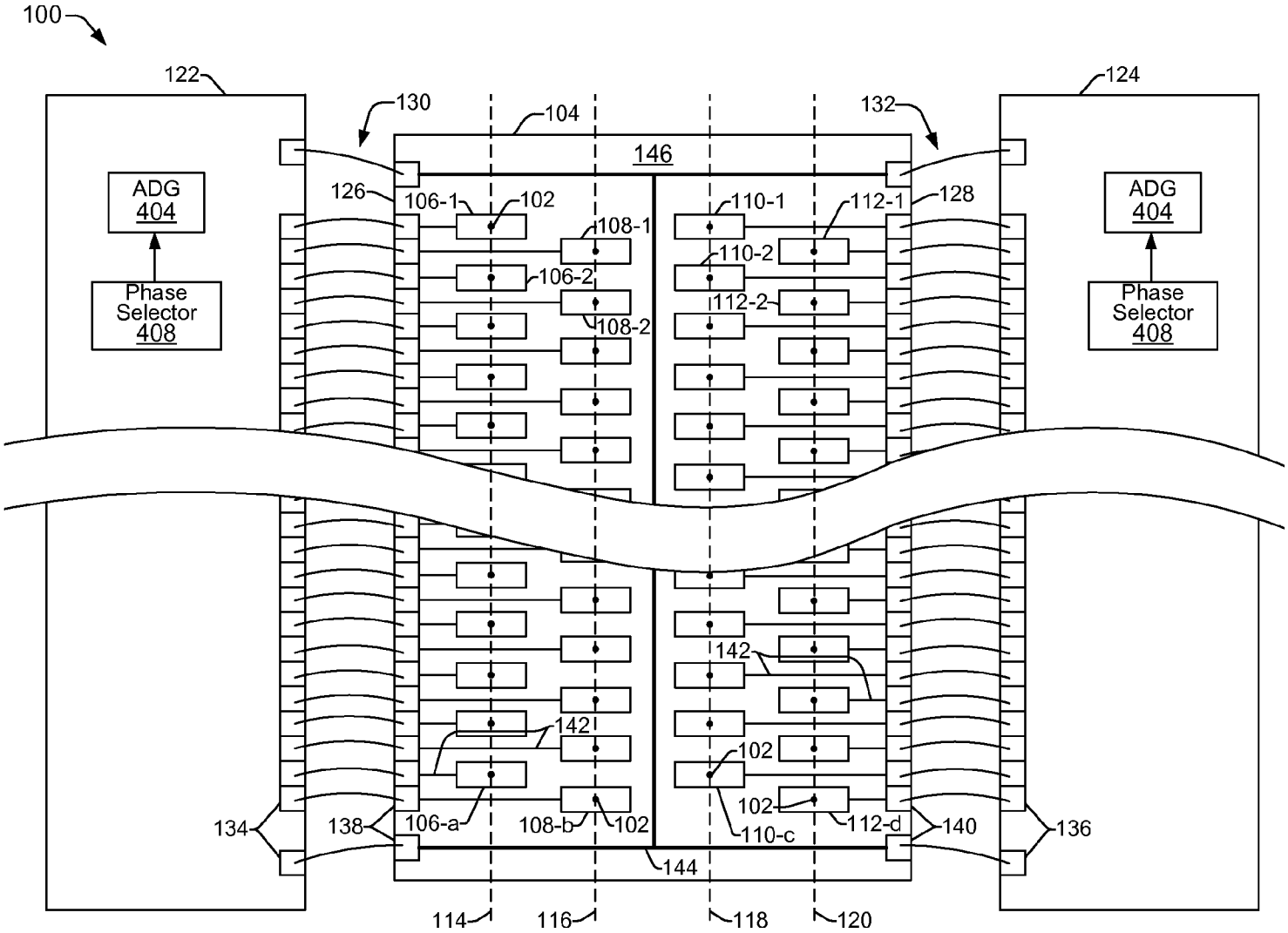
FIG. 1 shows a portion of an example piezoelectric printhead assembly suitable for providing multiple delayed waveform signals to drive print nozzles on an example micro-electro mechanical system (MEMS) die.

Examples described herein relate to piezoelectric printhead assemblies and methods. More specifically, in some example assemblies, a drive ASIC (application specific integrated circuit) includes an arbitrary data generator (ADG) selectable to provide a digital data sequence used to construct multiple delayed (i.e., temporally offset) waveform signals for driving print nozzles. Driving print nozzles with multiple delayed waveform signals helps to reduce peak currents when firing multiple nozzles simultaneously. The use of digital source data from a single ADG RAM circuit to construct multiple delayed waveform nozzle-drive signals enables a significant reduction in the use of silicon die area on the drive ASIC and a smaller form factor for the ASIC. This results in a reduced cost for the ASIC and a narrower print zone width for the printhead assembly, which helps to improve print quality. Among other advantages, example printhead assemblies described herein help to provide increased nozzle density, increased reliability, increased image quality, and/or increased printing speed, as compared to other piezoelectric printhead assemblies.

Piezoelectric printing is a form of drop-on-demand printing where a fluid drop (e.g., an ink drop) is ejected from a nozzle of a die when an actuation pulse is provided to the nozzle. For piezoelectric printing, the actuation pulse is provided as an electrical drive voltage to a piezoelectric material of the die. The piezoelectric material deforms in response to the actuation pulse, causing a fluid drop to be ejected from the nozzle.

Prior piezoelectric printhead assemblies used in some piezoelectric printers include a linear, or one dimensional array of nozzles located on a micro-electro-mechanical die. Such piezoelectric printhead assemblies can use a high power waveform amplifier that is located away from the micro-electro-mechanical die to mitigate the effects of the large amount of heat generated by the amplifier. The heat can be problematic because the viscosity of the fluids used for piezoelectric printing is affected by temperature and temperature fluctuations. The transfer of amplifier heat into the fluids can reduce image quality. For example, a rise in temperature of the fluid used in piezoelectric printing due to the waveform amplifier heat can cause undesirable drop size variation and/or undesirable placement of drops on the media. For these prior piezoelectric printhead assemblies, a drive waveform can be sent over a flex interconnect to a drive multiplexer coupled to a one dimensional array of nozzles located on the micro-electro mechanical die. In contrast to such piezoelectric printhead assemblies, example piezoelectric printhead assemblies disclosed herein include a micro-electro-mechanical system (MEMS) die with nozzles driven by multiple delayed waveform signals generated on an adjacent ASIC that is coupled to the MEMS die by wire bonds. As noted above, such printhead assemblies help to reduce peak currents which can reduce the amount of heat generated by waveform amplifiers. In addition, the example printhead assemblies enable a narrower print zone width and provide increased nozzle density, increased reliability, increased image quality, and/or increased printing speed.

FIG. 1 illustrates a portion of a piezoelectric printhead assembly 100 suitable for providing multiple delayed waveform signals to drive print nozzles 102 on a micro-electro mechanical system (MEMS) die 104. The assembly 100 includes the MEMS die 104, which is also commonly referred to as a printhead die 104. The MEMS die 104 can include a number of piezoelectric materials 106-1, 106-2, . . . , **106-*a*; 108-1, 108-2, . . . , 108-*b*; 110-1, 110-2, . . . , 110-*c*; and 112-1, 112-2, . . . , 112-*d***. Reference letters a, b, c, and d, each represent an independent integer value. In some examples, a, b, c, and d, each have an equal integer value.

As shown in FIG. 1, the piezoelectric materials 106-1, 106-2, . . . , **106-*a*, can be associated with a first column 114 of nozzles 102; the piezoelectric materials 108-1, 108-2, . . . , 108-*b* can be associated with a second column 116 of nozzles 102; the piezoelectric materials 110-1, 110-2, . . . , 110-*c* can be associated with a third column 118 of nozzles 102; and the piezoelectric materials 112-1, 112-2, . . . , 112-*d*** can be associated with a fourth column 120 of nozzles 102. Each nozzle 102 can have a number of associated piezoelectric materials. Thus, an actuation pulse may be provided to a number of piezoelectric materials to eject a drop from a particular nozzle 102.

The piezoelectric printhead assembly 100 can include a first application specific integrated circuit (ASIC) die 122 and/or a second ASIC die 124. In some examples, the first ASIC die 122 and the second ASIC die 124 have a single, common, design. For example, the first ASIC die 122 and the second ASIC die 124 can have the same configuration incorporating like components prior to their being coupled to the MEMS die 104. Thus, prior to ASIC dies 122 and 124 being coupled to MEMS die 104, the ASIC dies 122 and 124 are interchangeable. This provides the additional advantage that a single type of ASIC die can be fabricated for use in the piezoelectric printhead assembly 100. In some examples, ASIC dies 122 and 124 include an arbitrary data generator (ADG) 404 to provide a single digital data sequence, and a phase selector 408 to generate multiple delayed or temporally offset digital data sequences from the single digital data sequence of the ADG 404. In some examples, one of the ASIC dies 122 or 124, is rotated 180 degrees relative to the other ASIC die, and is located transverse the MEMS die 104 relative to that ASIC die. Accordingly, a first ASIC die 122 can be coupled to a first side 126 of MEMS die 104, and the second ASIC die 124 can be rotated 180 degrees relative to the first ASIC die 122 and be coupled to a second side 128 of the MEMS die 104.

As shown in FIG. 1, the first ASIC die 122 is coupled to the MEMS die 104 by a plurality of wire bonds 130, and the second ASIC die 124 is coupled to the MEMS die 104 by another plurality of wire bonds 132. The composition of the wire bonds 130 and 132 can include metals such as gold, copper, aluminum, silver, palladium, or alloys thereof, among others. The wires utilized for wire bonds 130 and 132 can have a diameter in the range of about 10 microns to 100 microns, for example. Forming the wire bonds 130 and 132 can include various bonding methods such as ball bonding, wedge bonding, compliant bonding, or combinations thereof, among others.

As shown in FIG. 1, the first ASIC die 122 can include a plurality of wire bond pads 134, the second ASIC die 124 can include a plurality of wire bond pads 136, the MEMS die 104 can include a first plurality of wire bond pads 138 near a first side 126 of the die 104, and the MEMS die 104 can include a second plurality of wire bond pads 140 near a second side 128 of the die 104. The plurality of wire bond pads 134 and the first plurality of wire bond pads 138 can be used to couple the first ASIC die 122 to the MEMS die 104 with the plurality of wire bonds 130. Similarly, the plurality of wire bond pads 136 and the second plurality of wire bond pads 140 can be used to couple the second ASIC die 124 to the MEMS die 104 with the plurality of wire bonds 132.

As shown in FIG. 1, the MEMS die 104 can include a plurality of traces 142. The plurality of traces 142 couple the first plurality of wire bond pads 138 to the piezoelectric materials associated with the first column 114 of nozzles 102 and the second column 116 of nozzles 102, and they couple the second plurality of wire bond pads 140 to the piezoelectric materials associated with the third column 118 of nozzles 102 and the fourth column 120 of nozzles 102. The MEMS die 104 also includes a ground 144 to which each of the piezoelectric materials associated with the first column 114 of nozzles 102, the second column 116 of nozzles 102, the third column 118 of nozzles 102, and the fourth column 120 of nozzles 102, can be coupled.

As mentioned above, the MEMS die 104 can include a first side 126 and a second side 128. In some examples, the first side 126 and/or the second side 128 are perpendicular to a rear face 146 of the MEMS die 104. In some examples, the first side 126 and/or the second side 128 are perpendicular to a shooting face of the MEMS die 104, discussed further herein. In some examples, the rear face 146 and the shooting face are parallel to one another.

As shown in FIG. 1, in some examples the first ASIC die 122 is adjacent to the first side 126 of the MEMS die 104, and the second ASIC die 124 is adjacent to the second side 128 of the MEMS die 104. Locating the first ASIC die 122 and the second ASIC die 124 adjacent to the respective sides of the MEMS die 104 can help to accommodate an increased wire bond density, as discussed further below.

In some examples, the first ASIC die 122, the MEMS die 104, and the second ASIC die 124 do not overlie one another. That is, the first ASIC die 122 does not overlie the MEMS die 104 or the second ASIC die 124, the MEMS die 104 does not overlie the first ASIC die 122 or the second ASIC die 124, and the second ASIC die 124 does not overlie the first ASIC die 122 or the MEMS die 104. Thus, a planar cross section of the MEMS die 104 that is perpendicular to the first side 126 of the MEMS die and the second side 128 of the MEMS die 104 can be entirely located between the first ASIC die 122 and the second ASIC die 124.

Using wire bonds 130 and 132 to respectively couple the first ASIC die 122 and the second ASIC die 124 to the MEMS die 104 can help to provide an increased nozzle density. Furthermore, using the wire bonds 130 and 132 to respectively couple the first ASIC die 122 and the second ASIC die 124 to the MEMS die 104 can quadruple a nozzle density as compared to other piezoelectric printers that utilize a flex interconnect to couple a multiplexer to a die. The use of flex interconnects cannot provide a high enough interconnect density to enable a nozzle density of the piezoelectric printhead assemblies disclosed herein.

Figure 2:
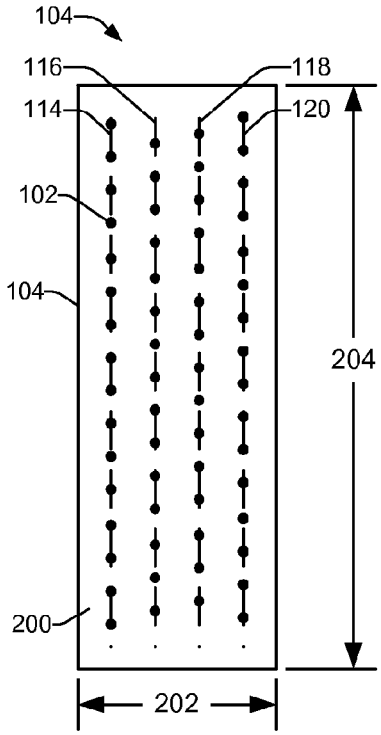
FIG. 2 shows a portion of an example MEMS die such as the MEMS die of FIG. 1.

FIG. 2 illustrates a portion of a MEMS die 104, such as the MEMS die 104 shown in FIG. 1. As shown in FIG. 2, the MEMS die 104 can include a shooting face 200 and a plurality of nozzles 102. In some examples the plurality of nozzles 102 can be arranged in a two dimensional array. As shown in FIG. 2, the plurality of nozzles can extend in a crosswise direction 202 across the shooting face 200 and extend in a longitudinal direction 204 along the shooting face 200. In some examples, the MEMS die 104 can include a first column 114 of nozzles 102, a second column 116 of nozzles 102, a third column 118 of nozzles 102, and a fourth column 120 of nozzles 102. While FIG. 2 shows four columns of nozzles extending along the longitudinal direction 204, other examples can include a lesser or greater number of columns of nozzles. For example, in different implementations the MEMS die 104 may include two columns of nozzles or six columns of nozzles. In some examples, the MEMS die 104 has a nozzle density of at least 1200 nozzles per inch.

Figure 3:
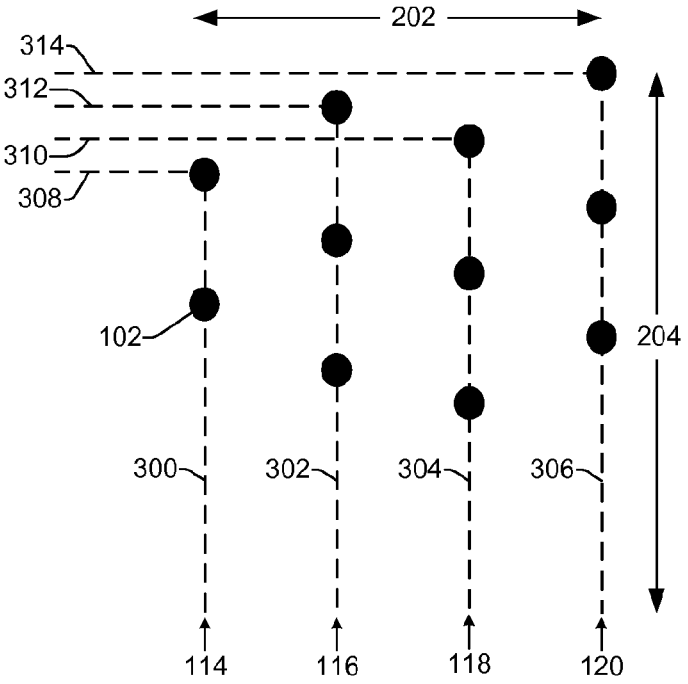
FIG. 3 shows a plurality of nozzles in an example arrangement on a portion of an example MEMS die.

FIG. 3 shows a plurality of nozzles 102 in an example arrangement on a portion of a MEMS die 104. As noted above, the plurality of nozzles 102 can extend in a crosswise direction 202, and they can extend in the longitudinal direction 204. As shown in FIG. 3, nozzles in a first column 114 can be associated with a longitudinal axis 300, nozzles in a second column 116 can be associated with a longitudinal axis 302, nozzles in the a third column 118 can be associated with a longitudinal axis 304, and nozzles in a fourth column 120 can be associated with a longitudinal axis 306. In some examples, the longitudinal axis 300 can be separated from the longitudinal axis 302 by a distance ranging from about 0.0466 hundredths of an inch to about 0.0500 hundredths of an inch; the longitudinal axis 302 can be separated from the longitudinal axis 304 by a distance ranging from about 0.0600 hundredths of an inch to about 0.0667 hundredths of an inch, and the longitudinal axis 304 can be separated from the longitudinal axis 306 by a distance ranging from about 0.0466 hundredths of an inch to about 0.0500 hundredths of an inch.

As shown in FIG. 3, nozzles in the first column 114 can be associated with a crosswise axis 308, nozzles in the second column 116 can be associated with a crosswise axis 312, nozzles in the third column 118 can be associated with a crosswise axis 310, and nozzles in the fourth column 120 can be associated with a crosswise axis 314. In some examples, the crosswise axis 308 can be separated from the crosswise axis 310 by a distance ranging from about 0.0004 hundredths of an inch to about 0.0033 hundredths of an inch; the crosswise axis 310 can be separated from the crosswise axis 312 by a distance ranging from about 0.0004 hundredths of an inch to about 0.0033 hundredths of an inch, and the crosswise axis 312 can be separated from the crosswise axis 314 by a distance ranging from about 0.0004 hundredths of an inch to about 0.0033 hundredths of an inch.

Figure 4:
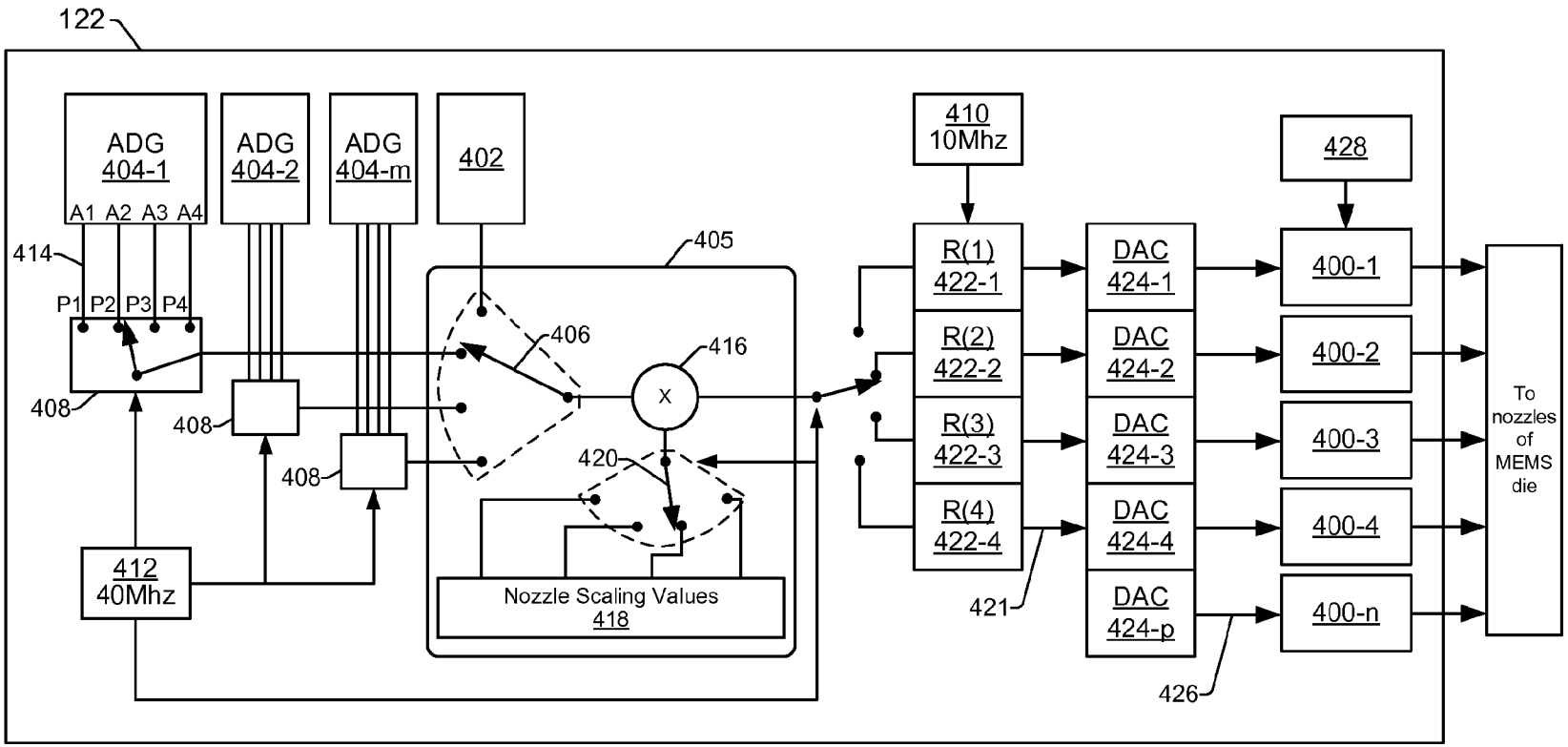
FIG. 4 shows example components of an example ASIC die, such as the ASIC die of FIG. 1.

FIG. 4 illustrates components of an example ASIC die 122, such as ASIC die 122 and/or ASIC die 124 as discussed above with regard to FIG. 1. As mentioned above, in some examples, a first ASIC die 122 and a second ASIC die 124 can have a single design that is common to each die. Thus, a second ASIC die 124 can incorporate the same components as the ASIC die 122 illustrated in FIG. 4.

The ASIC die 122 can include a number of driver amplifiers 400 (illustrated as amplifiers 400- 1, 400-2, 400-3, 400-4, . . . , **400-*n*, where n is an integer value). For instance, n can have a value equal to one half of a number of nozzles 102 of a MEMS die 104 to which the ASIC die 122 is wire bonded. In some examples, a total number of a first plurality of wire bonds coupling an ASIC die 122 to a MEMS die 104 can be equal to a total number of a second plurality of wire bonds. For instance, a MEMS die 104 having 1056 nozzles 102, can be coupled to a first ASIC die 122 and to a second ASIC die 124. Thus, the first ASIC die 122 can include 528 driver amplifiers 400 and the second ASIC 124 die can also include 528 driver amplifiers 400. In such an example, the ASIC die 122 can control a first half of the nozzles 102 of a MEMS die 104 and a second ASIC die 124 can control a second half of the nozzles 102 of the MEMS die 104**.

Fluid (e.g., ink) ejected from the nozzles 102 can be sensitive to thermal variation. For instance, a change of one degree Celsius can cause undesirable drop size variations and/or undesirable placement of drops on the media resulting in noticeable print defects. As mentioned, the ASIC dies 122 and 124 as shown in FIG. 1 are wire bonded to a MEMS die 104. Because the ASIC dies are wire bonded to the MEMS die, the ASIC dies are located in close proximity (i.e., adjacent) to the MEMS die. To help reduce print defects, the driver amplifiers 400 can be low power amplifiers. Using low power amplifiers 400 can help to maintain the printing fluid at a constant temperature that does not increase by one degree Celsius or more due to heat generated by the driver amplifiers. Accordingly, in some examples, the driver amplifiers 400 have a constant bias power dissipation in a range from about 0.5 milliwatts to about 3.0 milliwatts. In other examples, the driver amplifiers 400 can have a constant bias power dissipation of about 1.0 milliwatts.

The ASIC die 122 can include a rest voltage component 402. The rest voltage component 402 enables nozzles that are not being fired to be maintained at a constant, rest voltage. In addition to rest voltage component 402, the ASIC die 122 can include a number or arbitrary data generators (ADG) 404 (illustrated as ADG's 404-1, 404-2, . . . , **404-*m*, where m is an integer value). In some examples, m is in a range from 16 to 32. In some examples, individual nozzle control and/or nozzle-drive waveform generation is provided by ASIC die 122 with the assistance of a conditioner unit 405. The conditioner unit 405 can receive digital input such as digital data sequences from the number of ADG's 404 and the rest voltage component 402. The conditioner unit 405 can include an ADG selector 406 to select an available digital data sequence provided by a particular ADG 404. The digital data sequence selection (i.e., the ADG 404 selection) can be based on current pixel data, future pixel data, past pixel data, and/or calibration data, which can be provided to the ADG selector 406. For instance, the ADG selector 406 may use a two bit data protocol for specifying if a specific arbitrary digital data sequence will be selected for a particular nozzle 102. As an example, "00" may indicate rest voltage; "01" may indicate selection of an ADG 404 having a digital data sequence that enables a single drop nozzle-drive waveform for firing; "10" may indicate selection of an ADG 404 having a digital data sequence that enables a double drop nozzle-drive waveform for firing; and "11" may indicate selection of an ADG 404 having a digital data sequence that enables a triple drop nozzle-drive waveform for firing. Other configurations are also possible. For example, in another implementation, "01" may indicate selection of an ADG 404** having a digital data sequence that enables a double drop nozzle-drive waveform, and so on. In some examples, current pixel data can correspond to "0" or "1" for a present firing cycle, past pixel data can correspond to pixel times that have already occurred, and future pixel data can correspond to a pixel that has not yet occurred.

Each ADG 404 provides a particular digital data sequence that can be used as source data to construct multiple, identical, temporally offset, digital data sequences (i.e., identical digital data sequences that are delayed in time with respect to one another). The temporally offset data sequences can be subsequently conditioned and constructed (e.g., through driver amplifiers 400) into nozzle-drive waveforms that can be used to drive print nozzles 102 on a MEMS die 104 in a manner that delays the firing of nozzles with respect to one another. Using temporally delayed versions of the same nozzle-drive waveform to drive different nozzles 102 can help to reduce the number of nozzles firing simultaneously, and thereby reduce the peak currents drawn by the printhead assembly 100. In general, the ejection of fluid from a nozzle 102 is influenced by a nozzle-drive waveform when the waveform is applied to deflect the piezoelectric material corresponding to that nozzle. Nozzle-drive waveforms can have different voltages, widths, and/or shapes that can be varied to provide different drop characteristics, such as drop weight and velocity, for example. Different nozzle-drive waveforms, conditioned and constructed from different digital data sequences generated by different ADG's 404-1, 404-2, . . . , **404-*m***, may each correspond to a unique combination of voltage, pulse width, time delay, and/or shape.

In some examples, an ADG 404 is provided in a 256×8 bit RAM (random access memory) storage component having 256, eight-bit voltage values. Thus, the digital source data stored in each ADG RAM 404 can be accessed to form a digital data sequence that comprises numerous data steps, with each step defined by an 8 bit digital number from the RAM 404 that represents an incremental voltage level between 0 and 255. For example, a first step in a digital data sequence could be a data step at a level of 60, defined by an 8 bit digital value of 00111100, a second step in a digital data sequence could be a data step at a level of 112, defined by an 8 bit digital value of 01110000, and so on. As noted herein, the digital data sequence from each ADG RAM 404 can be accessed multiple times to generate multiple, temporally offset (i.e., delayed) digital data sequences that can then be further conditioned into nozzle-drive waveforms.

In general, the frequency operation of the ADG RAM 404 is a multiple of the number of delayed data sequences the RAM 404 is providing. For example, as shown in FIG. 4, there are four phase read operations (P1, P2, P3, P4) performed on a selected ADG RAM 404-1 to generate four temporally offset (i.e., delayed with respect to one another) data sequences. Each phase P1, P2, P3, and P4, can be selected through a phase selector 408, and each phase corresponds with the generation of a particular delayed or temporally offset digital data sequence that will be used to construct a nozzle-drive waveform for a particular nozzle 102. Thus, a single ADG RAM 404 providing a single digital data sequence can be used to produce multiple delayed or temporally offset nozzle-drive waveforms to drive multiple nozzles. With the steps of each nozzle-drive waveform being updated at a 10 MHz clock frequency 410 (every 100 nanoseconds (nsec)), for example, the data sequences for each phase P1, P2, P3, and P4, that are being used to construct the nozzle-drive waveforms are also updating at a 10 MHz frequency. However, the ADG RAM 404-1 operates at a 40 MHz clock frequency 412 in order to provide each step of the digital source data from four RAM addresses (e.g., A1, A2, A3, A4) to the four phase read operations (P1, P2, P3, P4) which occur every 25 nsec. Each of the four data sequences built up through the four phase reads (P1, P2, P3, P4) will be identical, but will be temporally offset, or delayed, from one another. While examples are discussed herein with regard to four temporally offset data sequences generated through four phase read operations P1, P2, P3, and P4, from a single ADG RAM 404, such examples are not intended to be limiting. In fact, other configurations are possible and contemplated herein. For example, in different implementations a single ADG RAM 404 providing a single digital data sequence can be used to produce a greater or fewer number of delayed or temporally offset nozzle-drive waveforms to drive multiple nozzles. In a particular example, a single digital data sequence from a single ADG RAM 404 might be used to produce ten delayed nozzle-drive waveforms to drive ten nozzles where each nozzle-drive waveform is updated at 10 MHz (every 100 nanoseconds (nsec)). In such a case, the ADG RAM 404 can operate at 100 MHz in order to provide each step of the digital source data to ten different phase read operations occurring every 10 nsec.

Figure 5:
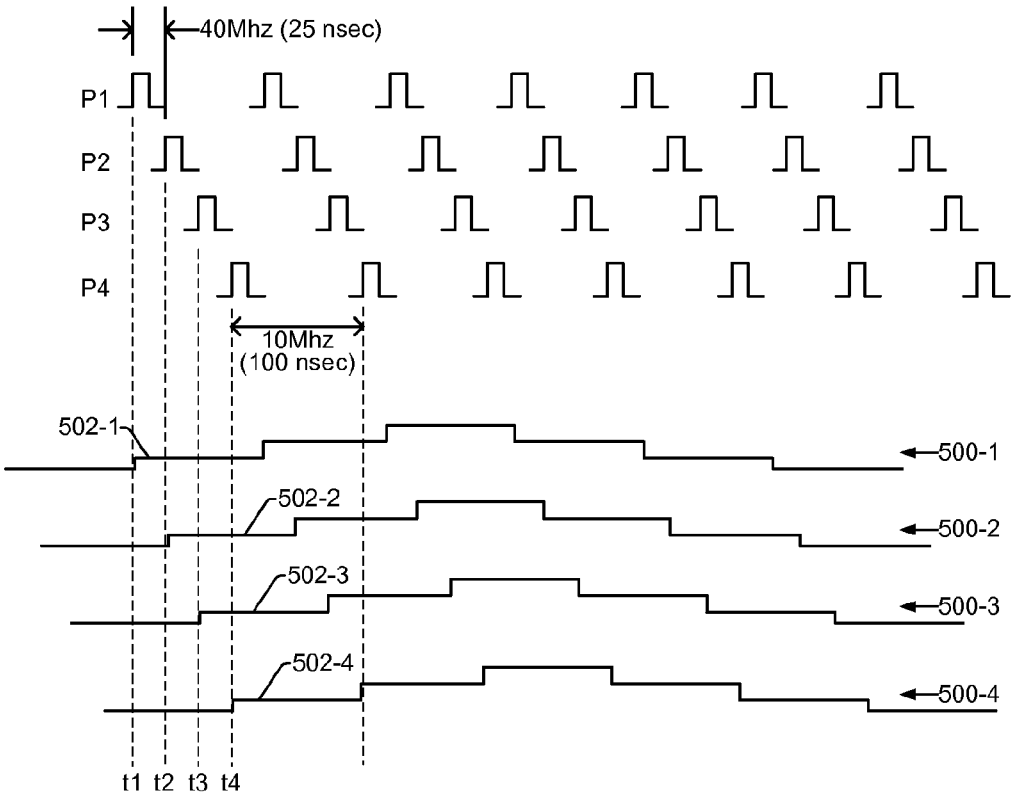
FIG. 5 shows a timing example of an example four phase read operation to read source data from a single ADG RAM.

FIG. 5 shows an example of timing for a four phase read operation that can be used to read source data from a single ADG RAM 404, such as ADG RAM 404-1, and to generate four identical source data sequences 500 (illustrated as data sequences 500-1, 500-2, 500-3, 500-4) that are delayed, or temporally offset, from one another. Each data sequence 500 read by the four phases P1, P2, P3, and P4, can eventually be used to construct a corresponding nozzle-drive waveform signal to drive a print nozzle 102 on a MEMS die 104. Referring to FIGS. 4 and 5, in this example, the four phase read operations (P1, P2, P3, P4) are driven by a 40 MHz clock 412, with each step of the digital source data sequence being updated on a 10 MHz clock 410. That is, a data read at a particular address (e.g., A1) of the ADG RAM 404-1 can begin with phase P1 via a phase selector 408, for example, and then subsequent data reads at different addresses (e.g., A2, A3, A4) can be made by switching the phase selector 408 at 40 MHz through phases P2, P3, and P4. Thus, with each phase read operation, a portion (e.g., a digital data step) of each data sequence 500-1, 500-2, 500-3, and 500-4, is accessed as an 8 bit data value (i.e., 0 to 255) from the digital source data in ADG RAM 404-1 every 25 nanoseconds (nsec)), so that after 100 nsec, a single digital data step of each data sequence 500-1, 500-2, 500-3, and 500-4, has been generated for each phase. As shown in FIG. 4, each phase (P1, P2, P3, P4) can read data from a different address (e.g., A1, A2, A3, A4) of the ADG RAM 404-1 using a separate bus line 414. After the phase P4 data is read, the address locations being read at the ADG RAM 404-1 can be updated and the next step of the source data sequence from the ADG RAM 404-1 can be read, beginning again with a phase P1 read. This process continues as each digital data step or portion of each of the temporally offset (i.e., delayed) data sequences 500-1, 500-2, 500-3, and 500-4, is read from the ADG RAM 404-1.

Referring still to FIGS. 4 and 5, at a first time (e.g., t1), a first phase P1 data read is made at an address Al of the ADG RAM 404-1, which can result in an 8 bit data value that defines a first step 502-1 of a digital data sequence 500-1. At a second time (e.g., 25 nsec later, at t2) following the first phase P1, a second P2 data read is made at an address A2 of the ADG RAM 404-1, which can result in an 8 bit data value that defines a first step 502-2 of a delayed digital data sequence 500-2. Data can be similarly read from the ADG RAM 404-1 at times t3 and t4 for steps 502-3 and 502-4 for phases P3 and P4, respectively. Each step (e.g., 502) of a digital source data sequence 500 can be defined as an 8 bit digital number read from ADG RAM 404-1 that represents a range of 0 to 255.

Referring again to FIG. 4, in addition to ADG selector 406, conditioner unit 405 can include a scaler 416, also referred to as a nozzle scaling multiplier 416. For each nozzle 102 of the MEMS die 104, a particular nozzle scaling value 418 can be determined and stored on the ASIC 122. A nozzle scaling value 418 can be selected for each nozzle 102 by a scaling selector 420. While the steps of each nozzle-drive waveform are updated at a 10 MHz clock frequency 410 (every 100 nanoseconds (nsec)), for example, the multiplier 416 and scaling selector 420 operate at a higher frequency that is a multiple of the 10 MHz nozzle update frequency. The multiple is equal to the number of multiple delayed digital data sequences being generated from the ADG RAM 404 using phase selector 408. In the FIG. 4 example, because four delayed digital data sequences are being generated, the multiplier 416 and scaling selector 420 operate/update at a 40 MHz rate (every 25 nsec). Operating the multiplier 416 at a higher frequency than the nozzle update frequency enables each multiplier to scale multiple nozzles 102, and provides a corresponding reduction in the number of multipliers on the ASIC 122. Thus, in the example of FIG. 4, instead of having a separate multiplier to provide scaling for each nozzle 102, each nozzle scaling multiplier 416 operating at 4 times the nozzle update frequency can provide scaling for four nozzles 102, resulting in a four times reduction in the number of nozzle scaling multipliers 416 on the ASIC 122.

A nozzle scaling multiplier 416 can scale each nozzle by multiplying each digital data step (i.e., the 8 bit digital data value) of a digital data sequence read from an ADG RAM 404 by a nozzle scaling value 418 (i.e., a numerical factor), such as by a percentage increase or a percentage decrease.

For example, an 8 bit digital value of 01101110 representing a relative voltage level of 110 out of 256 levels, could be multiplied by a nozzle scaling value 418 of 1.10 (a 10% increase) to produce a scaled 8 bit digital value of 01111001 representing a relative voltage level of 121 out of 256 levels. Thus, the multiplier 416 can be used to alter the digital data sequences from the ADG RAMs 404-1, 404-2, . . . , **404-*m*, that are to be used to construct nozzle-drive waveforms for each respective nozzle 102 that the ASIC die 122 or 124** controls.

A nozzle scaling value 418 can be determined for each nozzle 102 of the MEMS die 104. For example, each nozzle 102 of the MEMS die 104 can be calibrated to determine variances due to manufacturing and/or processing tolerances. The calibration of each nozzle can be used to determine a nozzle scaling value 418 that scales a nozzle-drive waveform to achieve fluid drops that are uniform in size/volume and velocity for all nozzles 102. This calibration can be performed periodically, such as daily, or per each use, or per each print job, and so on. The calibration can also be selectable by a user. The ASIC die 122 can store the scaling values 418 for each respective nozzle 102 that the ASIC die 122 controls. Digital data sequences being read at different phases (e.g., P1, P2, P3, P4) from the ADG RAMs 404-1, 404-2, . . . , **404-*m*, to construct nozzle-drive waveforms for particular nozzles 102 can be scaled with the particular scaling values associated with those nozzles. Thus, the digital values of a data sequence generated by phase P1 to be conditioned into a nozzle-drive waveform to drive a particular nozzle can be multiplied by a particular scaling value 418 associated with that particular nozzle. As shown in FIG. 4, the scaling values 418 are updated to the multiplier 416 at the same rate (i.e., 40 MHz) that the phases P1, P2, P3, and P4, are switched. Thus, as a first step of a digital data sequence is read from an ADG RAM 404 in phase P1, the appropriate scaling value 418 for the nozzle to be driven using the P1 data sequence is applied through the multiplier 416. As each data read phase is advanced at a 40 MHz rate, so too are the scaling values 418 advanced and applied through the multiplier 416**.

In some examples, the scaling values 418 are predetermined at the time of manufacture during a calibration routine and stored on the ASIC 122 and 124, as appropriate, depending on which nozzles are to be controlled by which ASIC. However, as noted above, nozzle calibrations can also be performed periodically, such as on a daily basis, before or during each use, before or during each print job, and so on. Thus, in some examples, the scaling values 418 are updateable during printing by a printing device. In other examples, a scaling value 418 of a nozzle is updateable based on scaling values 418 stored for adjacent nozzles. In still other examples, a scaling value of a nozzle can be updateable dynamically based on firing data being sent to an adjacent nozzle. Thus, a scaling value of a nozzle can be adjusted dynamically to compensate for the effect of an adjacent nozzle that is ejecting or about to eject a fluid ink drop.

Figure 6:
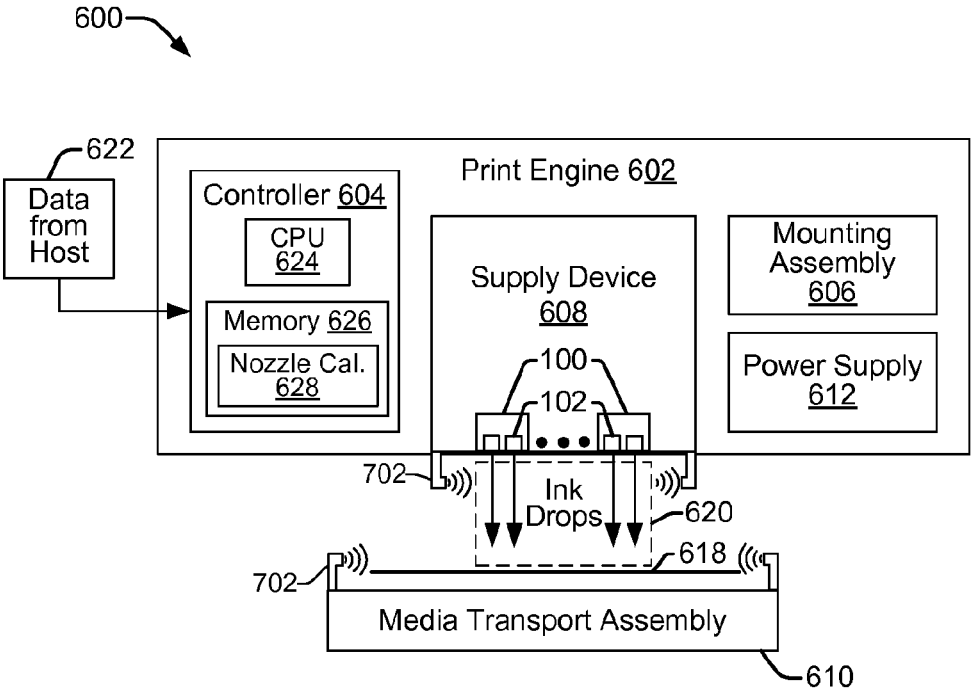
FIG. 6 shows an example of an inkjet printing device suitable for implementing an example piezoelectric printhead assembly to provide multiple delayed digital data sequences from a single ADG RAM.

FIG. 6 shows an example of an inkjet printing device (i.e., printer) 600 suitable for implementing a piezoelectric printhead assembly 100 that provides multiple delayed waveform signals to drive print nozzles on a MEMS die 104. In this example, the inkjet printer 600 includes a print engine 602 having a controller 604, a mounting assembly 606, replaceable fluid supply device(s) 608, a media transport assembly 610, and at least one power supply 612 that provides power to the various electrical components of inkjet printer 600. The inkjet printer 600 further includes a piezoelectric printhead assembly 100 to eject drops of ink or other fluid through a plurality of nozzles 102 toward print media 618 so as to print onto the media 618. In some examples, a piezoelectric printhead assembly 100 can be an integral part of a supply device 608, while in other examples a piezoelectric printhead assembly 100 can be mounted on a print bar (not shown) of mounting assembly 606 and coupled to a supply device 608 (e.g., via a tube). Print media 618 can be any type of suitable sheet or roll material, such as paper, card stock, transparencies, Mylar, polyester, plywood, foam board, fabric, canvas, and the like.

In the FIG. 6 example, a piezoelectric printhead assembly 100 uses a piezoelectric material actuator to generate pressure pulses that force ink drops out of a nozzle 102. Nozzles 102 are typically arranged in one or more columns or arrays along a MEMS die 104 of assembly 100 such that properly sequenced ejection of ink from nozzles 102 causes characters, symbols, and/or other graphics or images to be printed on print media 618 as the printhead assembly 100 and print media 618 are moved relative to each other.

Mounting assembly 606 positions the printhead assembly 100 relative to media transport assembly 610, and media transport assembly 610 positions print media 618 relative to printhead assembly 100. Thus, a print zone 620 is defined adjacent to nozzles 102 in an area between printhead assembly 100 and print media 618. In one example, print engine 602 is a scanning type print engine. As such, mounting assembly 606 includes a carriage for moving printhead assembly 100 relative to media transport assembly 610 to scan print media 618. In another example, print engine 602 is a non-scanning type print engine. As such, mounting assembly 606 fixes printhead assembly 100 at a prescribed position relative to media transport assembly 610 while media transport assembly 610 positions print media 618 relative to printhead assembly 100.

Electronic controller 604 typically includes components of a standard computing system such as a processor (CPU) 624, a memory 626, firmware, and other printer electronics for communicating with and controlling inkjet printhead assembly 100, mounting assembly 606, media transport assembly 610 and other functions of printer 600. Memory 626 comprises a non-transitory machine-readable (e.g., computer/processor-readable) storage medium that can include any device or non-transitory medium able to store code, executable instructions, and/or data for use by a computer system. Thus, memory 626 can include, but is not limited to, volatile (i.e., RAM) and nonvolatile (e.g., ROM, hard disk, floppy disk, CD-ROM, etc.) memory components comprising computer/processor-readable media that provide for the storage of computer/processor-readable coded instructions, data structures, program modules, and other data for printer 600. Electronic controller 604 receives data 622 from a host system, such as a computer, and temporarily stores the data 622 in a memory. Data 622 represents, for example, a document and/or file to be printed. Thus, data 622 forms a print job for inkjet printer 600 that includes print job commands and/or command parameters. Using data 622, electronic controller 604 controls printhead assembly 100 to eject ink drops from nozzles 102 in a defined pattern that forms characters, symbols, and/or other graphics or images on print medium 618.

Figure 7:
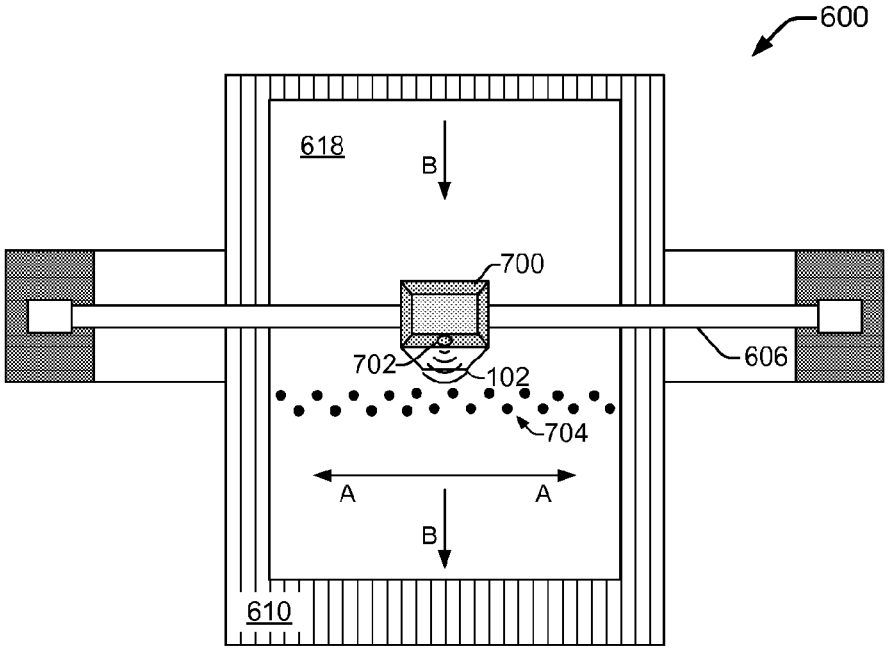
FIG. 7 shows an example of a scanning type inkjet printer suitable for implementing an example piezoelectric printhead assembly to provide multiple delayed digital data sequences from a single ADG RAM.

FIG. 7 shows an example of a scanning type inkjet printer 600, in which mounting assembly 606 includes a carriage 700 that scans piezoelectric printhead assembly 100 in forward and reverse passes across the width of the media page 618 in a generally horizontal manner, as indicated by horizontal arrows labeled A. Between carriage scans, the media page 618 is incrementally advanced by media transport assembly 610, as indicated by the vertical arrows labeled B. Thus, media transport assembly 610 moves the media page 618 through the printer 600 along a print media path that properly positions media page 618 relative to printhead assembly 100 as drops of ink are ejected onto the media page 618.

Media transport assembly 610 can include various mechanisms (not shown) that assist in advancing a media page 618 through a media path of printer 600. These can include, for example, a variety of media advance rollers, a moving platform, a motor such as a DC servo motor or a stepper motor to power the media advance rollers and/or moving platform, combinations of such mechanisms, and so on.

In addition to carriage 700, mounting assembly 606 includes a scanning sensor 702 fixed to the carriage 700. In some examples, sensor 702 is a lightness/spot sensor that scans printed dots 704 on a media page 618 and measures reflectance from the media page 618 in order to enable a determination as to the sizes and positions of the dots 704. As discussed herein below, such information can be analyzed by the printer 600 to determine the volume and velocity of fluid ink drops being ejected from nozzles 102 of the piezoelectric printhead assembly 100. In some examples, sensor 702 comprises a light emitter to emit light onto the media page 618 and a light detector to detect light reflected off of the media page 618. In some examples, sensor 702 comprises a light emitter and light detector that are positioned on either side of the carriage 700 and that travel along with the carriage to enable shining light through a print zone 610 to monitor fluid drops traversing a pathway from the printhead assembly 100 to the media page 618. In some examples, sensor 702 comprises a light emitter and light detector that are part of the printer 600 and are positioned on either side of a media transport assembly 610 of the printer 600 to enable shining light through a print zone 610 to monitor fluid drops traversing a pathway from the printhead assembly 100 to the media page 618. An analysis of the amount of light being blocked by fluid drops passing through the print zone 610 can provide information that can be analyzed by the printer 600 to determine the volume and velocity of fluid ink drops being ejected from nozzles 102 of the piezoelectric printhead assembly 100. While particular sensors 702 and sensor configurations have been discussed, it should be understood that other types of sensing devices implemented in various configurations are possible and contemplated herein to gather fluid drop information that can be analyzed to determine fluid drop sizes, volumes, shapes, velocities, trajectories, and so on, as might be applicable to the calibration of nozzles 102 and the determination of scaling values 418 for nozzles 102.

Figure 8:
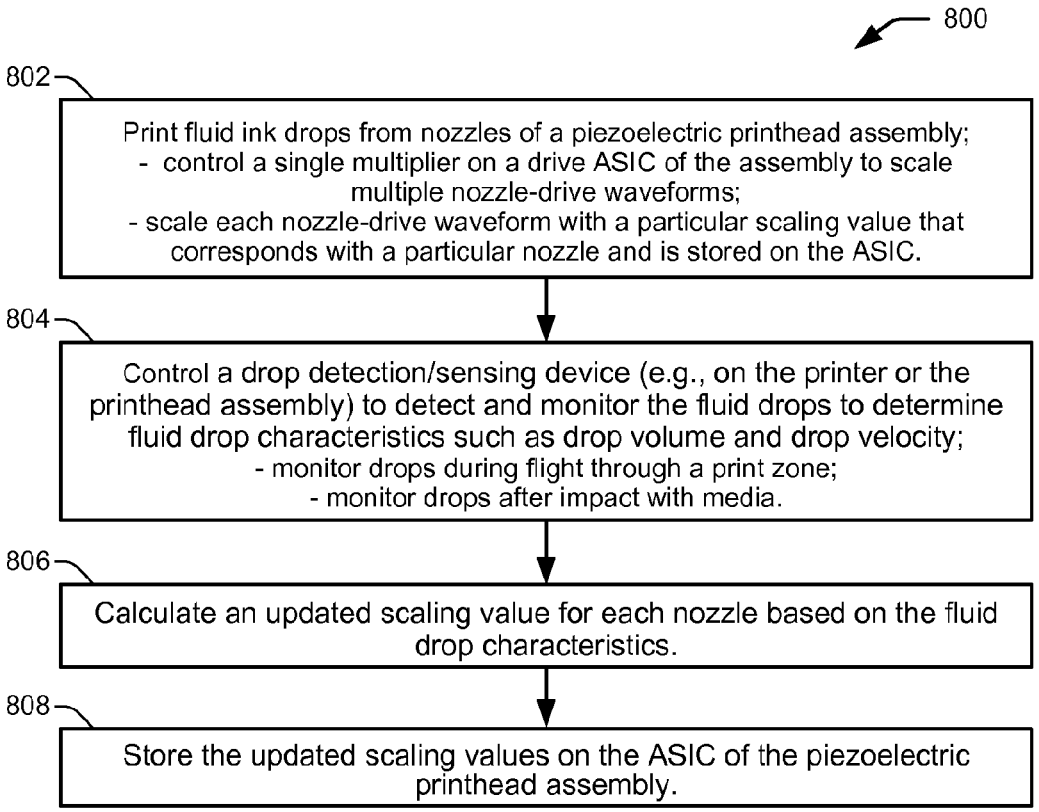
FIG. 8 shows a flow diagram that illustrates an example method corresponding with a nozzle calibration routine.

Referring again to FIG. 6, controller 604 includes a nozzle calibration module 628 stored in memory 626. Module 628 includes instructions executable on processor 624 to run a calibration routine that controls components of printer 600 and determines updated scaling values 418 for each nozzle 102 of a MEMS die 104 of a printhead assembly 100. FIG. 8 shows a flow diagram that illustrates an example method 800 that corresponds with the calibration routine. Referring now generally to FIGS. 6, 7, and 8, instructions from module 628 are executable to cause the printer 600 to print fluid ink drops from nozzles 102 of a piezoelectric printhead assembly 100 (block 802, FIG. 8). Printing the fluid drops can include controlling a single multiplier on a drive ASIC of the printhead assembly 100 to scale multiple nozzle-drive waveforms, where each of the nozzle-drive waveforms is scaled using a particular scaling value stored on the ASIC that corresponds with a particular nozzle. Instructions from module 628 are further executable to control a sensing device (e.g., on the printer or the printhead assembly) to detect and monitor the fluid drops to determine fluid drop characteristics such as drop volume and drop velocity (block 804, FIG. 8), and to calculate an updated scaling value for each nozzle based on the fluid drop characteristics (block 806, FIG. 8). As noted above, fluid drops can be monitored in a number of ways, such as monitoring the drops during their flight through a print zone, and/or monitoring the drops after they impact the media. Instructions from module 628 are then further executable to store the updated scaling values 418 on the ASIC of the piezoelectric printhead assembly 100 (block 808, FIG. 8).

Referring again to FIG. 4, each digital data step (i.e., the 8 bit digital data value) of a digital data sequence read from an ADG RAM 404 that has been scaled by multiplier 416 is provided by the conditioner unit 405 to a storage register 422 (illustrated as registers R(1) 422-1, R(2) 422-2, R(3) 422-3, R(4) 422-4). Thus, each of the scaled digital data steps read from RAM 404 in phases P1, P2, P3, and P4, are stored in corresponding registers R(1) 422-1, R(2) 422-2, R(3) 422-3, and R(4) 422-4. The scaled digital data steps are held in the registers 422 until it is time to advance the digital data sequence from the ADG RAM 404 and read again using phase P1. When the next P1 read occurs, the four scaled digital data steps are clocked out of the registers 422 and into digital-to-analog converters (DACs) 424 (illustrated as DACs 424-1, 424-2, 424-3, 424-4, . . . , **424-*p*). Thus, the ASIC die 122 can include a number of DACs, 424-1, 424-2, 424-3, 424-4, . . . , 424-*p*, where p is an integer value. For instance, p can have a value equal to one half of a number of nozzles 102 of a MEMS die 104 to which the ASIC 122 is wire bonded. Thus, there can be a respective DAC 424 for each nozzle 102 that the ASIC die 122 controls. Each of the number of DACs 424 can receive a respective, scaled, digital data step or portion of a digital data sequence stream, such as from the data step outputs 421 from storage registers R(1) 422-1, R(2) 422-2, R(3) 422-3, and R(4) 422-4, and can convert these scaled, digital data step outputs 421 into analog voltage step outputs 426. The digital data step outputs 421 are low voltage digital voltage levels on the order of 1 to 3 volts, and the DACs can convert the digital data step outputs 421 to low voltage analog voltage step outputs 426 in the range of about 1 to 3 analog volts. Each respective low voltage analog voltage step output 426 can be sent to a respective driver amplifier 400 (i.e., amplifier 400-1, 400-2, 400-3, 400-4, . . . , 400-*n*), where the low voltage analog voltage step output 426** can be amplified to a full nozzle-drive voltage in the range of about 10 to 30 volts.

The ASIC die 122 can include a control sequencer 428. The control sequencer 428 can store and provide digital control sequences such as a fire cycle sequence corresponding to the operation of the amplifier 400, for each of the respective driver amplifiers 400-1, 400-2, 400-3, 400-4, . . . , **400-*n*. For example, a fire cycle can begin with the control sequencer 428 resetting drive circuits for each respective nozzle 102 that the ASIC die 122 controls. Amplifier control sequences stored by the control sequencer 428 can be loaded for each respective nozzle 102 that the ASIC die 122 controls. Amplifier calibration data per nozzle can also be loaded for each respective nozzle 102 that the ASIC die 122 controls. Selected digital data sequences from an ADG RAM 404** that have been conditioned and converted into corresponding nozzle-drive waveforms can be loaded for nozzles that are firing in a particular firing cycle, and non-firing nozzles can be driven at the rest voltage.

Similarly, as noted above, a second ASIC die 124 can include the same components of ASIC die 122, and thereby can control nozzles 102 of the MEMS die 104 with a unique nozzle-drive waveform generated at each nozzle 102.

Figure 9:
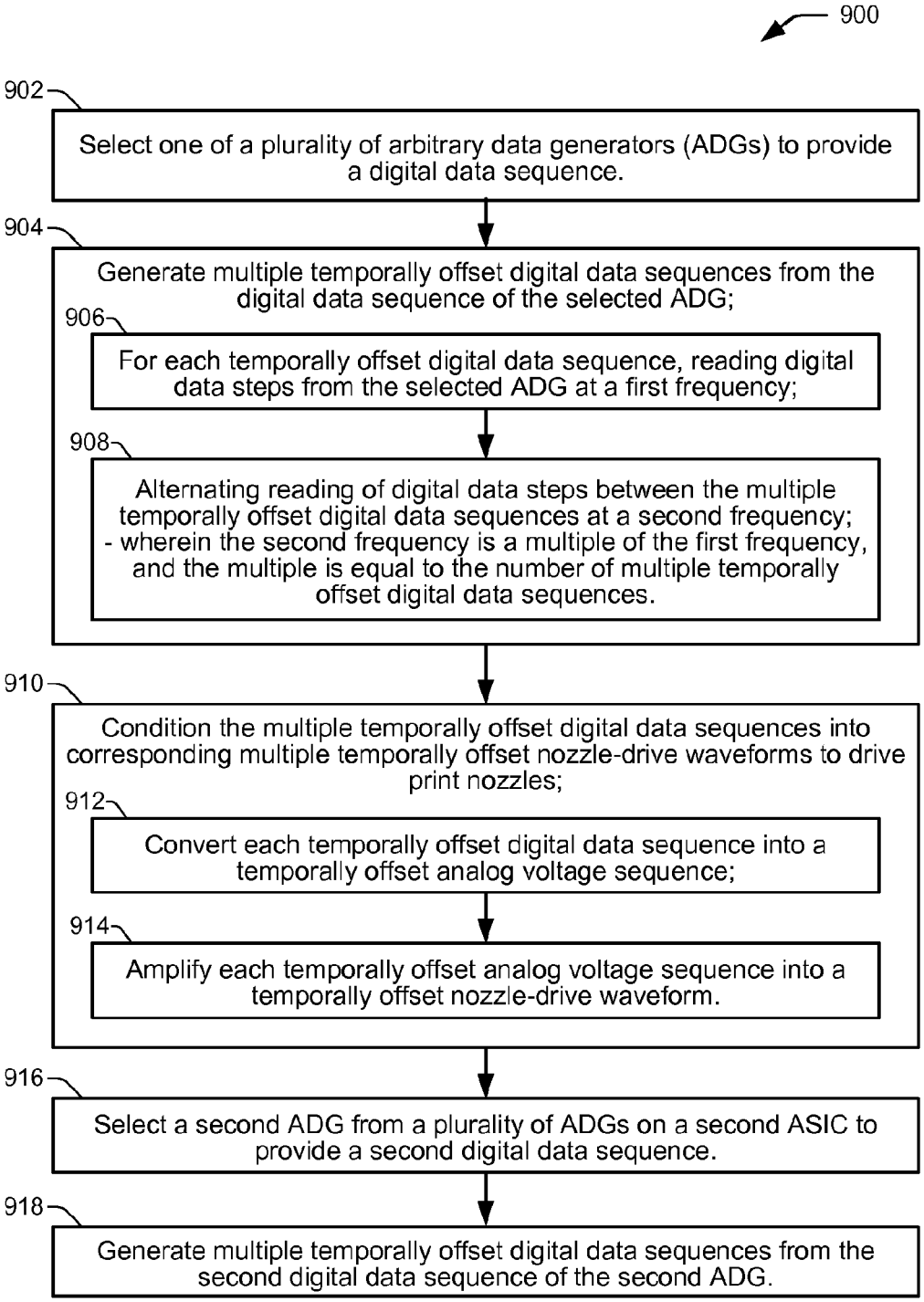
FIG. 9 shows a flow diagram that illustrates an example method of driving nozzles on a piezoelectric printhead assembly.

FIG. 9 shows a flow diagram that illustrates an example method 900 of driving nozzles on a piezoelectric printhead assembly. The method 900 is associated with examples discussed herein with regard to FIGS. 1-8, and details of the operations shown in method 900 can be found in the related discussion of such examples. Method 900 may include more than one implementation, and different implementations of method 900 may not perform every operation presented in the flow diagram. Therefore, while the operations of method 900 are presented in a particular order within the flow diagram, the order of their presentation is not intended to be a limitation as to the order in which the operations may actually be implemented, or as to whether all of the operations may be implemented. For example, one implementation of method 900 might be achieved through the performance of a number of initial operations, without performing one or more subsequent operations, while another implementation of method 900 might be achieved through the performance of all of the operations.

Referring to the flow diagram of FIG. 9, an example method 900 begins at block 902 where a first operation includes selecting one of a plurality of arbitrary data generators (ADGs) to provide a digital data sequence. The plurality of ADGs can be provided on an ASIC die, and a conditioner unit on the ASIC die can include an ADG selector to select the particular ADG based, for example, on print information that can include current pixel data, future pixel data, past pixel data, print calibration data, and so on. At block 904 of method 900, multiple temporally offset (i.e., delayed) digital data sequences can be generated from the digital data sequence of the selected ADG. In some examples, generating the digital data sequences can include reading digital data steps from the selected ADG at a first frequency for each temporally offset digital data sequence, and alternating the reading of digital data steps between the multiple temporally offset digital data sequences at a second frequency, as indicated at blocks 906 and 908, respectively. In such examples, the second frequency is a multiple of the first frequency, and the multiple is equal to the number of multiple temporally offset digital data sequences.

The method 900 continues at block 910 with conditioning the multiple temporally offset (i.e., delayed) digital data sequences into corresponding multiple temporally offset nozzle-drive waveforms to drive print nozzles. As noted at blocks 912 and 914, respectively, conditioning the data sequences can include converting each temporally offset digital data sequence into a temporally offset analog voltage sequence, and amplifying each temporally offset analog voltage sequence into a temporally offset nozzle-drive waveform. As shown at block 916, the method 900 can also include electing a second ADG from a plurality of ADGs on a second ASIC to provide a second digital data sequence. From the second digital data sequence on the second ASIC, multiple temporally offset digital data sequences can be generated. As noted above, multiple offset/delayed digital data sequences can be conditioned to provide nozzle-drive waveforms with which to drive nozzles on a MEMS die coupled to the first and second ASICs via wire bonds, for example.

What is claimed is:

1. A piezoelectric printhead assembly comprising:

a micro-electro mechanical system (MEMS) die including a plurality of nozzles;

an application-specific integrated circuit (ASIC) die coupled to the MEMS die by a plurality of wire bonds, wherein each of the wire bonds corresponds to a respective nozzle of the plurality of nozzles;

an arbitrary data generator (ADG) on the ASIC to provide a digital data sequence; and a phase selector to enable multiple data read operations of the ADG to generate multiple delayed digital data sequences.

2. A piezoelectric printhead assembly as in claim 1, further comprising:

multiple storage registers, each register corresponding with a respective delayed digital data sequence to store a digital data step of the respective delayed digital data sequence.

3. A piezoelectric printhead assembly as in claim 2, wherein each digital data step of a delayed digital data sequence comprises an 8 bit digital number representing a digital voltage level.

4. A piezoelectric printhead assembly as in claim 3, further comprising:

a digital-to-analog converter (DAC) associated with each nozzle, each DAC to receive a respective 8 bit digital number from a respective storage register and to convert the respective 8 bit digital number to an analog voltage.

5. A piezoelectric printhead assembly as in claim 4, further comprising:

a first clock to drive the phase selector at a first frequency such that each data read operation acquires and stores a single digital data step of a delayed digital data sequence in a respective storage register at the first frequency; and a second clock running at a second frequency to drive multiple digital data steps from the storage registers into respective DACs simultaneously at a second frequency.

6. A piezoelectric printhead assembly as in claim 5, wherein the first frequency is a multiple of the second frequency, the multiple being equal to the number of multiple delayed digital data sequences.

7. A piezoelectric printhead assembly as in claim 4, further comprising:

a driver amplifier associated with each nozzle to receive an analog voltage from a DAC and to condition the analog voltage into a portion of a nozzle-drive waveform.

8. A piezoelectric printhead assembly comprising:

a micro-electro mechanical system (MEMS) die including a plurality of nozzles;

a first and a second application-specific integrated circuit (ASIC) coupled to the MEMS die by respective first and second pluralities of wire bonds, wherein each of the first plurality of wire bonds corresponds to a respective nozzle of a first number of the plurality of nozzles and each of the second plurality of wire bonds corresponds to a respective nozzle of a second number of the plurality of nozzles; and, on each ASIC:

a plurality of arbitrary data generators (ADGs), each ADG to provide a digital data sequence;

an ADG selector to select a digital data sequence of a selected ADG; and a phase selector to enable the construction of multiple delayed digital data sequences from the selected ADG.

9. A piezoelectric printhead assembly as in claim 8, further comprising:

a first and second plurality of power amplifiers on the first and second ASIC, respectively, each power amplifier corresponding with a particular nozzle, and each power amplifier to amplify one of the multiple delayed digital data sequences into a nozzle-drive waveform capable of driving the particular nozzle.

10. A method of driving nozzles on a piezoelectric printhead assembly comprising:

selecting one of a plurality of arbitrary data generators (ADGs) to provide a digital data sequence; and generating multiple temporally offset digital data sequences from the digital data sequence of the selected ADG.

11. A method as in claim 10, wherein generating multiple temporally offset digital data sequences comprises:

for each temporally offset digital data sequence, reading digital data steps from the selected ADG at a first frequency; and alternating reading of digital data steps between the multiple temporally offset digital data sequences at a second frequency.

12. A method as in claim 11, wherein the second frequency is a multiple of the first frequency, and the multiple is equal to the number of multiple temporally offset digital data sequences.

13. A method as in claim 10, further comprising:

conditioning the multiple temporally offset digital data sequences into corresponding multiple temporally offset nozzle-drive waveforms to drive print nozzles.

14. A method as in claim 13, wherein conditioning the multiple temporally offset digital data sequences comprises:

converting each temporally offset digital data sequence into a temporally offset analog voltage sequence; and, amplifying each temporally offset analog voltage sequence into a temporally offset nozzle-drive waveform.

15. A method as in claim 10, wherein selecting one of a plurality of ADGs comprises selecting a first ADG on a first application-specific integrated circuit (ASIC), the method further comprises:

selecting a second ADG from a plurality of ADGs on a second ASIC to provide a second digital data sequence; and, generating multiple temporally offset digital data sequences from the second digital data sequence of the second ADG.

* * * * *